US005174103A

United States Patent [19]

Nishioka

[11] Patent Number: 5,174,103

[45] Date of Patent: Dec. 29, 1992

[54] BOBBIN SORTING DEVICE FOR PREVENTING OVERSUPPLY OF A SELECTED YARN KIND TO A WINDER SECTION

[75] Inventor: Yoshiyuki Nishioka, Kusatsu, Japan

[73] Assignee: Murata Kikai Kabushiki Kaisha, Kyoto, Japan

[21] Appl. No.: 663,750

[22] Filed: Mar. 4, 1991

[30] Foreign Application Priority Data

Mar. 5, 1990 [JP] Japan ..... 2-21467[U]

[51] Int. Cl.[5] ..... B65H 67/06; D01H 9/18

[52] U.S. Cl. ..... 57/281; 242/35.5 A

[58] Field of Search ..... 57/281, 270, 90; 242/35.5 A; 209/656, 657, 927

[56] References Cited

U.S. PATENT DOCUMENTS

| | | | |
|---|---|---|---|
| 4,605,177 | 8/1986 | Uchida et al. | 242/35.5 A |
| 4,634,066 | 1/1987 | Matsui et al. | 242/35.5 A |
| 4,681,231 | 7/1987 | Ueda et al. | 242/35.5 A X |
| 4,683,713 | 8/1987 | Matsui et al. | 57/281 |
| 4,694,949 | 9/1987 | Nakagawa | 209/927 X |
| 4,718,560 | 1/1988 | Kiriake | 209/927 X |
| 4,776,468 | 10/1988 | Kiriake | 242/35.5 A X |
| 4,856,723 | 8/1989 | Tone | 242/35.5 A X |
| 4,930,302 | 6/1990 | Yamamoto et al. | 242/35.5 A X |

FOREIGN PATENT DOCUMENTS

| | | | |
|---|---|---|---|
| 0311394 | 12/1989 | European Pat. Off. | 57/281 |

*Primary Examiner*—Daniel P. Stodola
*Assistant Examiner*—John Rollins
*Attorney, Agent, or Firm*—Spensley Horn Jubas & Lubitz

[57] ABSTRACT

A bobbin sorting device which can prevent bobbins from packing any winding section is provided adjacent to a junction of a loop passage extending close to each of fine spinning frames and an automatic winder and a common passage along the automatic winder. The bobbin sorting device comprises trays carrying bobbins of different kinds of yarn to be supplied to the automatic winder through the common passage, trays having an identifying groove, and bobbin sorting means provided at the inlet of the common passage for engaging the groove of the tray.

9 Claims, 2 Drawing Sheets

BOBBIN SORTING DEVICE FOR PREVENTING OVERSUPPLY OF A SELECTED YARN KIND TO A WINDER SECTION

FIELD OF THE INVENTION

This invention relates to a bobbin sorting device for sorting bobbins of different kinds of spun yarn.

RELATED ART STATEMENT

In view of the necessity which has recently arisen for winding separately a plurality of kinds of spun yarn which are each made in a small quantity, we, the applicants of this application, have proposed a system for supplying a plurality of bobbins carrying different kinds of yarn to a plurality of winding sections, respectively, of an automatic winder, and also a bobbin sorting mechanism intended for use in that system (see, for example, the Japanese patent application entitled "Bobbin Conveying Tray" and laid open to the public under No. 67370/1985).

The bobbin sorting mechanism comprises an identifying groove (or grooves) formed in the peripheral surface of each tray on which a bobbin is carried, and a groove gauge which is engageable with the identifying groove. A bobbin conveying passage is divided in a plurality of branches each leading to one of the winding sections. The groove gauge is provided at the junction of the branches to select a particular bobbin from a plurality of bobbins arriving one after another and carrying different kinds of yarn, so that the selected bobbin may be conveyed to the corresponding winding section.

Each winding section has a loop passage through which the bobbins (trays) which have been sorted by the groove gauge and conveyed into the winding section are distributed to winding units.

The loop passage, however, has a limited capacity, and is packed with new bobbins arriving one after another if the winding section has lowered its winding efficiency, or stopped its operation. A long time is wasted before the normal operation of the winding section is restored.

OBJECT AND SUMMARY OF THE INVENTION

Under these circumstances, it is an object of this invention to provide a bobbin sorting device which can prevent an oversupply of bobbins at any winding section.

The device of this invention comprises a plurality of trays carrying bobbins of different kinds of yarn which are conveyed through a common passage to a plurality of sections, respectively, of an automatic winder, the passage being divided in a plurality of branches each leading to one of the winder sections, a groove gauge provided at the junction of those branches, each of the trays having an identifying groove which enables the sorting of the tray by the groove gauge, and bobbin sorting means provided at the inlet of the passage engageably with the identifying groove of each of trays carrying bobbins of a particular kind of yarn to admit only those trays into the passage.

Bobbins of different kinds of yarn are sorted by the groove gauge and are each supplied to the corresponding section of the winder. If it has become necessary to interrupt the supply of bobbins of one kind of yarn to the winder, the bobbin sorting means functions to inhibit the entry of those bobbins into the passage leading to the winder and admit only bobbins of another kind of yarn into the passage.

DETAILED DESCRIPTION OF PREFERRED EMBODIMENT

A device embodying this invention will now be described with reference to the accompanying drawings.

Figure 1:
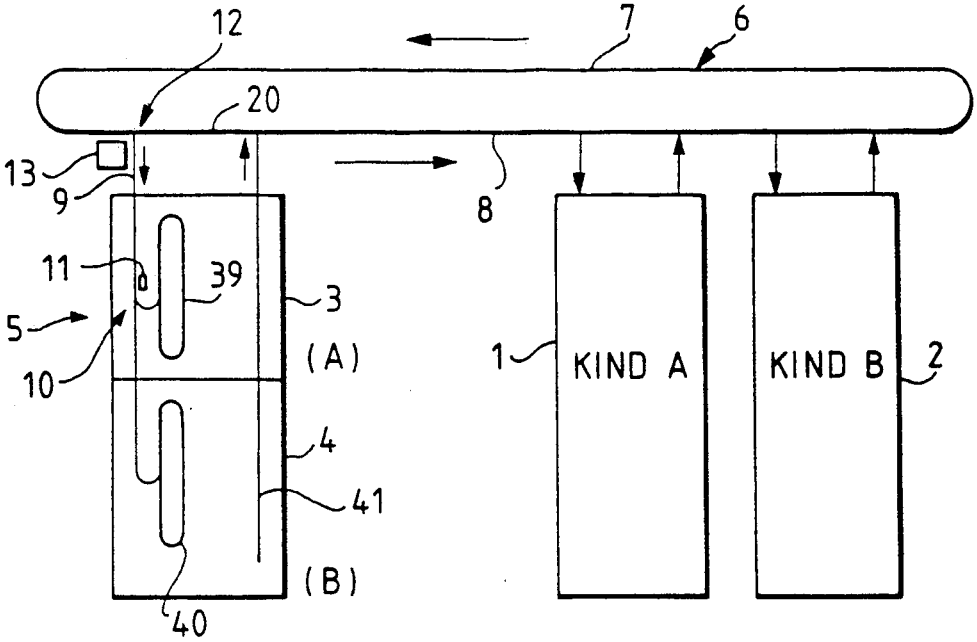
FIG. 1 is a schematic diagram showing a bobbin sorting device embodying this invention.

Reference is first made to FIG. 1 showing a bobbin conveying system including the bobbin sorting device embodying this invention.

The bobbin conveying system is provided for connecting an automatic winder and a plurality of fine spinning frames for producing bobbins of different kinds of spun yarn. The system shown in FIG. 1 connects two fine spinning frames 1 and 2 (which are intended for producing one kind of yarn designated as A and another kind of yarn designated as B, respectively) to the automatic winder 5 having two winding sections 3 and 4 provided for the two kinds of yarn, respectively.

The fine spinning frames 1 and 2 and the automatic winder 5 lie in parallel to one another. A loop passage 6 extends close to one end of each of the fine spinning frames 1 and 2 and the automatic winder 5 through which bobbins discharge and enter the spinning frame 1 or 2, or the winder 5. The loop passage 6 has a first portion 7 along which full bobbins are conveyed from the spinning frames 1 and 2 to the winder 5, and a second portion 8 along which empty bobbins are returned from the winder 5 to the spinning frames 1 and 2.

A common passage 9 is connected between the loop passage 6 and the automatic winder 5 for transferring full bobbins from the former to the latter. The common passage 9 has a branch formed in the upstream winding section 3 (for bobbins of yarn A). A groove gauge 11 is provided at the junction 10 between the common passage 9 and its branch for sorting bobbins of different kinds of yarn arriving one after another, so that bobbins of yarn A may be admitted into the branch, while bobbins of yarn B are conveyed along the passage 9 past the junction 10 into the downstream winding section 4.

The loop passage 6 and the common passage 9 have a junction 12 defining an inlet to the passage 9. Bobbin sorting means 13 is provided adjacent to the junction 12 and forms a salient feature of this invention.

Figure 2:
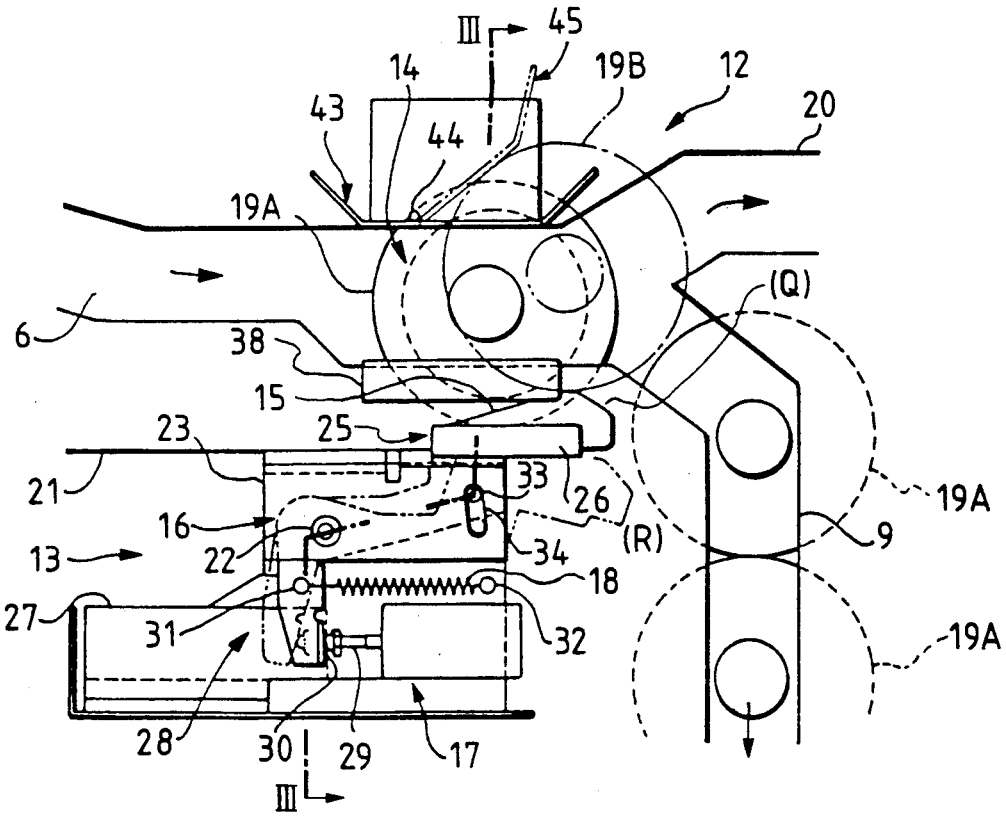
FIG. 2 is an enlarged top plan view showing a part of FIG. 1 in detail.
Figure 3:
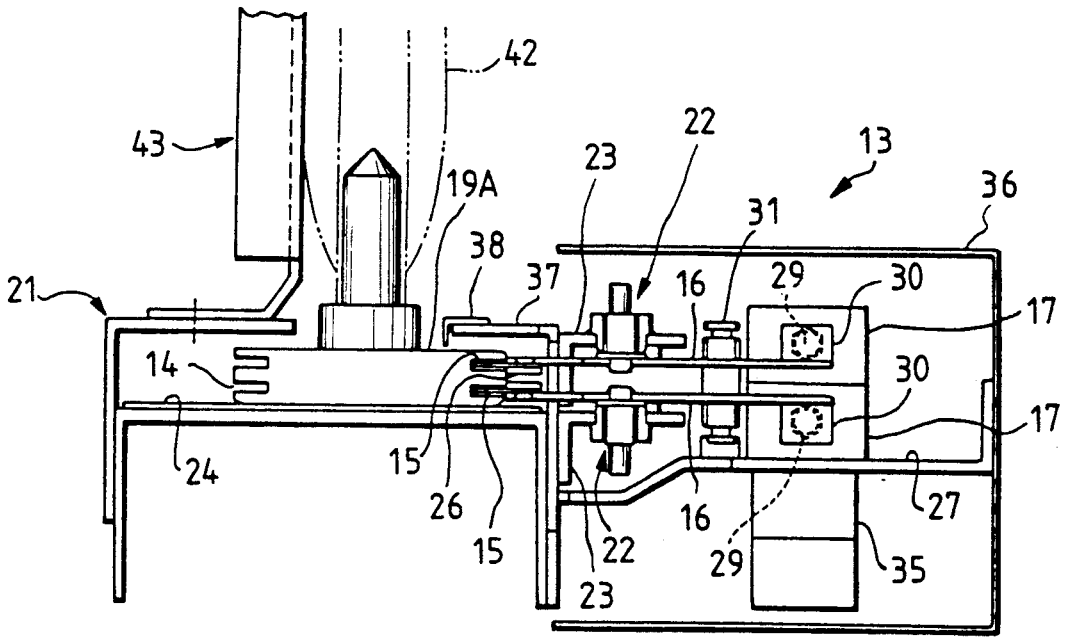
FIG. 3 is a sectional view taken along the line III—III of FIG. 2.

The bobbin sorting means 13 consists mainly of pair of vertically spaced apart levers 16 each having a selecting plate 15 which is engageable with an identifying groove 14, an air cylinder 17 provided for rotating each lever 16 in one direction, and a tension spring 18 urging each lever 16 to rotate in another direction, as shown in FIGS. 2 and 3. The number of the levers 16 depends on the number of the identifying grooves 14 formed on each tray. The two levers 16 are, therefore, provided in the device shown in the drawings, as it is designed for distinguishing trays 19A each carrying a bobbin of yarn A and having two identifying grooves 14 from trays 19B each carrying a bobbin of yarn B and not having any identifying groove. A guide plate 21 is provided adjacent to the junction 12 for guiding trays either from the loop passage 6 to the common passage 9, or to a bypass 20 leading to the second portion 8 of the passage 6 along which empty bobbins are conveyed. The bobbin sorting means 13 is situated slightly ahead (or upstream) of the junction 12. The guide plate 21 is so designed as to normally guide the trays from the loop passage 6 to the common passage 9.

Each lever 16 is formed by an L-shaped plate and is rotatably supported on a vertical shaft 22 spaced apart from the guide plate 21. The shaft 22 is supported by a bracket 23 connected to one side of the guide plate 21 and supports the lever 16 in its bent portion. The bracket 23 holds the lever 16 at such a level of height above the top surface of a belt conveyor 24 for the passage 6 that the lever 16 may be properly engageable with one of the identifying grooves 14, if any.

The selecting plate 15 is a thin plate which is engageable in one of the identifying grooves 14, and is secured between one end portion 25 of the lever 16 facing the common passage 9 and a block 26. The end portions 25 of the levers 16 and the blocks 26 are adapted to abut on the peripheral surface of a tray 19A and direct it toward the common passage 9 when the selecting plates 15 are engaged in the identifying grooves 14. When any tray 19B having no identifying groove 14 has arrived, the selecting plates 15 abut on its peripheral surface and directs it toward the bypass 20, as shown by a one-dot chain line in FIG. 2.

The air cylinders 17 are mounted on a base plate 27 connected to the guide plate 21. Each air cylinder 17 faces the other end portion 28 of one of the levers 16 and has a piston rod 29 adapted to abut on a flat plate 30 attached to the lever 16. The piston rod 29 is adapted to push the flat plate 30 and thereby rotate the lever 16 clockwise, as viewed in FIG. 2, to move its one end portion 25 away from the common passage 9.

The tension spring 18 extends between a pin 31 attached to the other end portion 28 of the lever 16 and a pin 32 secured to the base plate 27, and in parallel to the air cylinder 17. It urges the lever 16 to rotate counterclockwise, so that the end portion 25 of the lever 16 may engage a tray. The piston rod 29 of the air cylinder 17 in its retracted position serves as a stop against the lever 16 urged by the tension spring 18 and thereby holds the lever 16 in the position in which the selecting plate 15 and the one end portion 25 of the lever 16 engage a tray 19B (as shown at Q by solid lines in FIG. 2).

The lever 16 has a pin 33 upstanding from its one end portion 25 and the bracket 23 has an arcuate slot 34 in which the pin 33 is slidably fitted for guiding the lever 16 during its rotation. The air cylinder 17 is provided with an electromagnetic valve 35 adapted for supplying working air from a source of air supply not shown to the air cylinder 17, or stopping its supply. The air cylinders 17 and the levers 16 are enclosed in a cover 6 having an opening facing the common passage 9.

The guide plate 21 includes a top portion 37 facing the levers 16 below, and carrying a downwardly bent reference plate 38 adapted for holding a tray down against the belt conveyor 24 to ensure that the identifying grooves 14, if any, be kept in a proper relation in height to the levers 16.

The guide plate 21 carries on its portion remote from the bobbin sorting means 13 a guide plate 43 provided for abutting on a coil 42 of yarn wound on a bobbin and guiding the trays 19A and 19B carrying the coils, it toward the bobbin sorting means 13. The guide plate 43 extends along the loop passage 6. The guide plate 43 includes a downstream portion 45 joined to the rest thereof by a vertical hinge 44, so that the downstream portion 45 is rotatable to allow any tray 19B to be conveyed toward the bypass 20.

Although no detail of the groove gauge 11 is shown in FIG. 1, it has stationary selecting plate which are engageable with either the identifying grooves 14 of a tray or its peripheral surface to control the direction in which the tray is to be conveyed, so that only bobbins of yarn A may be supplied to the winding section 3. Each winding section 3 or 4 has a loop passage 39 or 40, respectively, through which the full bobbins arriving in the winding section 3 or 4 are appropriately distributed to winding units (not shown).

The automatic winder 5 also has an empty bobbin passage 41 spaced apart from the common passage 9 and extending to the second portion 8 of the loop passage 6.

Referring to the operation of the device as hereinabove described, the piston rods 29 of the air cylinders 17 usually stay in their extended positions to keep the end portions 25 of the levers 16 fully away from the common passage 9 (as shown at R by a two-dot chain line in FIG. 2). The full bobbins of two kinds of yarn which have arrived through the loop passage 6 from the fine spinning frames 1 and 2 are all admitted past the junction 12 into the common passage 9 and are sorted by the groove gauge 11 at the junction 10 for distribution between the winding sections 3 and 4.

If it has become necessary to interrupt the admittance of bobbins of yarn B into the common passage 9, as a result of, for example, the failure of the winding section 4 to continue its winding operation, the electromagnetic valve 25 is actuated to stop the supply of air to the air cylinders 17. As a result, the air cylinders 17 cease to hold the piston rods in their extended positions and allow the tension springs 18 to cause the levers 16 to rotate counterclockwise, as viewed in FIG. 2, so that the selecting plates 15 are advanced to their projected positions (Q).

If the tray which has arrived at the junction 12 is a tray 19A having the identifying grooves 14, the engagement of the selecting plates 15 with the identifying grooves 14 allows the tray 19A to move forward to the common passage 9 without causing it to go in any other direction. If it is a tray 19B having no identifying groove 14, the selecting plates 15 abut on its peripheral surface and direct the tray 19B toward the bypass 20. Thus, all bobbins of yarn B are rejected, and returned to the loop passage 6 through the bypass 20, while all bobbins of yarn A are supplied to the winding section 3 through the common passage 9.

When the loop passage 40 in the winding section 4 has recovered its normal flow and is ready to receive bobbins of yarn B, the air cylinders 17 are operated to extend the rods 29 to rotate the levers 16 in the opposite direction. As a result, the selecting plates 15 and the end portions 25 of the levers 16 move away from the common passage 9 and the junction 12 returns to its normal position, so that bobbins of yarn A and of yarn B are both admitted into the common passage 9.

The levers 16 carrying the selecting plates 15 engageable with the identifying grooves 14, which levers are movable to and away from the common passage 9 by the air cylinders 17 and the tension springs 18, enable the rejection of any bobbin of yarn B if any necessity for doing so has arisen, as hereinabove stated, and thereby prevent the clogging of the winding section 4.

The combination of the bobbin sorting means 13 and the identifying grooves 14 as hereinabove described is only illustrative and a variety of other arrangements are possible. For example, trays each having a single groove and trays each having a single groove which is lower in height can be used for carrying bobbins of two kinds of spun yarn, respectively, and two levers which are rotatable separately from each other can be employed for rejecting either bobbins of one or both kinds of yarn.

The loop passages 39 and 40 may each be provided with a sensor for detecting the presence of bobbins (in a clogging way) and outputting a signal to actuate the air cylinders, so that the admittance of a particular group of trays and the rejection of the other trays may automatically take place.

This invention has an outstanding advantage as is obvious from the foregoing description, and as will hereunder be summarized.

The identifying grooves formed in at least a part of trays carrying bobbins of different kinds of yarn, and the bobbin sorting means provided at the inlet of the passage leading to the automatic winder for engaging the identifying grooves of trays carrying bobbins of a particular kind of yarn to admit only those trays into the passage, make it possible to select the bobbins to be admitted into the winder, and thereby prevent the clogging of any winding section in the winder.

What is claimed is:

1. A bobbin sorting apparatus for use with a bobbin conveying system having a conveyor for conveying bobbins and a common passage, associated with the conveyor, for conveying bobbins, the apparatus comprising:

a plurality of bobbin carrying trays, wherein at least one of the trays has at least one identifying groove and wherein at least one of the trays does not have an identifying groove; and first sorting means associated with the conveyor and the common passage, moveable between at least a first position and a second position, for sorting the plurality of bobbin carrying trays such that only the trays defining the at least one identifying groove are allowed to pass from the conveyor to the common passage when the first sorting means is in the first position and all trays are allowed to pass from the conveyor to the common passage when the first sorting means is in the second position.

2. The apparatus of claim 1, wherein a first passage is associated with the common passage, the apparatus further comprising:

second sorting means, associated with the first passage and the common passage, for allowing only the trays defining at least one identifying groove to pass from the common passage to the first passage.

3. A bobbin sorting apparatus for use with a bobbin conveying system having first and second spinning frames, a conveyor for conveying bobbins associated with the spinning frames, and first and second winding sections, the apparatus comprising:

a common passage for conveying bobbins associated with the conveyor and the winding sections, the common passage and the conveyor defining a junction;

a plurality of first bobbin carrying trays associated with the first spinning frame and the first winding section;

a plurality of second bobbin carrying trays associated with the second spinning frame and the second winding section; and first sorting means associated with the junction, moveable between at least a first position and a second position, for sorting the first and second bobbin carrying trays such that only the first trays are allowed to pass from the conveyor to the common passage when the first sorting means is in the first position and the first and second trays are allowed to pass from the conveyor to the common passage when the first sorting means is in the second position.

4. The apparatus of claim 3, further comprising:

first and second loop passages, associated with the common passage and the first and second winding sections, respectively, for distributing sorted bobbins to the winding units; and second sorting means for allowing the first trays to pass from the common passage to the first loop passage.

5. The apparatus of claim 3, wherein the first trays define at least one identifying groove.

6. The apparatus of claim 5, wherein the first sorting means comprises a lever, a selecting plate, associated with the lever and engageable with the at least one identifying groove, first rotating means for rotating the lever in a first direction, and second rotating means for rotating the lever in a second direction.

7. The apparatus of claim 6, further comprising:

a reference plate for holding the trays against the conveyor such that the at least one identifying groove is maintained in a predetermined relationship with the lever.

8. The apparatus of claim 7, wherein the first and second trays carry coils of yarn, the apparatus further comprising:

a vertical guide plate for abutting the coils of yarn to guide the trays to a position adjacent the first sorting means.

9. The apparatus of claim 8, wherein the vertical guide plate comprises a rotatable portion, whereby the rotatable portion rotates to allow the trays to continue on the conveyor after passing the first sorting means.

* * * * *